US009887503B1

(12) United States Patent
Quinlan

(10) Patent No.: US 9,887,503 B1
(45) Date of Patent: Feb. 6, 2018

(54) MATING CONNECTOR FOR A MICRO USB CONNECTOR

(71) Applicant: Timex Group USA, Inc., Middlebury, CT (US)

(72) Inventor: David Quinlan, Plantsville, CT (US)

(73) Assignee: Timex Group USA, Inc., Middlebury, CT (US)

( * ) Notice: Subject to any disclaimer, the term of this patent is extended or adjusted under 35 U.S.C. 154(b) by 0 days.

(21) Appl. No.: 15/380,102

(22) Filed: Dec. 15, 2016

(51) Int. Cl.

| | |
|---|---|
| ***H01R 29/00*** | (2006.01) |
| ***H01R 24/64*** | (2011.01) |
| ***H01R 4/58*** | (2006.01) |
| ***H01R 13/42*** | (2006.01) |
| *H01R 107/00* | (2006.01) |

(52) U.S. Cl.
CPC ..... *H01R 24/64* (2013.01); *H01R 4/58* (2013.01); *H01R 13/42* (2013.01); *H01R 2107/00* (2013.01)

(58) Field of Classification Search
CPC ..... H01R 24/64; H01R 24/58; H01R 4/58; H01R 4/4818; H01R 12/78; H01R 2107/00
USPC ..... 439/176
See application file for complete search history.

(56) References Cited

U.S. PATENT DOCUMENTS

| | | | | |
|---|---|---|---|---|
| 6,688,911 | B2 * | 2/2004 | Fuerst | H01R 12/78 439/496 |
| 8,480,435 | B2 | 7/2013 | Hsiao et al. | |
| 8,684,752 | B2 | 4/2014 | Hsueh | |
| 2002/0081879 | A1 * | 6/2002 | Billman | H01R 24/58 439/176 |
| 2008/0218799 | A1 | 9/2008 | Hiew et al. | |
| 2010/0130042 | A1 * | 5/2010 | Gray | H01R 4/4818 439/176 |
| 2011/0254506 | A1 | 10/2011 | McGinley et al. | |
| 2013/0040484 | A1 | 2/2013 | Zmmermann et al. | |
| 2014/0224437 | A1 * | 8/2014 | Colson | E06B 9/42 160/291 |
| 2016/0294098 | A1 * | 10/2016 | Clark | G06F 21/83 |

FOREIGN PATENT DOCUMENTS

| | | |
|---|---|---|
| CN | 204067633 U | 12/2014 |
| CN | 205122872 U | 3/2016 |
| TW | M515754 | 1/2016 |

OTHER PUBLICATIONS

"Existing 90 Degree Micro USB connectors" https://www.google.com/search?q=90+degree+micro+usb&espv=2&biw=1920&bih=1075&source=lnms&tbm=isch&sa=X&ved=0ahUKEwjyyZuZ_ZDKAhWCFx4KHbwACqkQ_AUIBygC (Admitted prior art).

* cited by examiner

*Primary Examiner* — Jean F Duverne
(74) *Attorney, Agent, or Firm* — Carmody Torrance Sandak & Hennessey, LLP

(57) ABSTRACT

A mating connector construction that achieves a slimmer and smaller profile when mating with a conventional USB connector. A slimmer and smaller profile provides substantial advantages and additional uses of a USB connection, for example, with transmitting signals between a watch casing and a watchstrap, as but one example thereof. In a preferred embodiment, the USB connector is a micro USB connector.

5 Claims, 7 Drawing Sheets

MATING CONNECTOR FOR A MICRO USB CONNECTOR

BACKGROUND OF THE INVENTION

The present invention is directed to micro USB connectors generally, and in particular, to an improved mating connector construction that achieves a slimmer and smaller profile when mating with a conventional USB connector. A slimmer and smaller profile provides substantial advantages and additional uses of a USB connection, for example, with transmitting signals between a watch casing and a watchstrap, as but one example thereof.

USB connectors, including micro USB connectors, are well known in the art. One such example of a USB connector generally and a micro USB connector in particular, is illustrated in FIG. 1, which illustrates a conventional micro USB connector, generally indicated at 100, connected to a conventional mating connector, generally indicated at 200. As illustrated, it can be seen that the length (L) of mating connector 200 is about 1/25.4 inches/mm and in any event, is about 5× longer than the corresponding length of complementary USB connector housing 100.

Where space and/or size of the micro USB connection assembly is not a concern or constraint, the prior art assemblies, such as that illustrated in FIG. 1, may be an acceptable construction. However, where size and/or space is a concern, a mating connector such as that exemplified by connector 200, is less than desirable.

For example, in the field of wristwatches, it may be desirable to move components and/or other features from/off the watch head to other parts of the watch, such as the wriststrap, thereby permitting the watch head to remain small in size, aesthetically pleasing and provide an ergonomic fit to the user. However, such a configuration thus requires electrical and/or mechanical connections between the strap and the watch head. For example, it may be desirable to incorporate a flashlight, extra memory and/or an extra battery into the wristwatch, but less than desirable to place such accessories in the watch head itself. Placing such accessories in the watchstrap would be ideal. Making an improved connection between a mating connector and a conventional micro USB connector that allows for such expanded versatility and functionality of a wristwatch is desirable, and currently not achievable by conventional USB connectors.

Thus, perceived deficiencies still exist in the art. For example, it is desirable to provide a smaller and more compact USB connection assembly for utilization in smaller electronic components, such as timepiece generally and a wristwatch in particular.

It is thus believed that further advances to the state of the art are both desirable and achievable. In particular, it is desirable to provide a mating connector for a micro USB connector, but those skilled in the art will recognize that the present invention is also applicable to other conventional USB type connectors that will result in being smaller and more compact than heretofore known or envisioned. The present invention achieves this and other objectives as set forth herein.

SUMMARY AND OBJECTIVES OF THE INVENTION

It is thus an objective of the present invention to overcome the perceived deficiencies in the prior art.

Specifically, it is an objective of the present invention to provide a mating connector that is smaller and more compact than prior art mating connectors for USB connectors generally and micro USB connectors in particular.

Specifically, it is an objective of the present invention to provide a mating connector that orients the contact pad electrical contact surface orthogonally to the contact surface of the contact pins of a convention USB connector, which allows for a slimmer and more compact profile therefor;

Still a further objective of the present invention is to provide an improved mating connector for micro USB connectors that can be used in electronic assemblies, such as timepieces generally and wristwatches in particular.

Yet a further objective of the present invention is to provide an improved mating connector for micro USB connectors that allows for the expanded functionality of a timepiece, such as a wristwatch.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Therefore, to overcome the perceived deficiencies in the prior art and to achieve the objects and advantages set forth above and below, a preferred embodiment of the present invention is, generally speaking, directed to a mating connector that mates with a USB connector in general and a micro universal serial bus (USB) connector in particular, wherein the USB connector comprises a receptacle shell, a plurality of contact pins mounted on a support plate, wherein each of the contact pins has an electrical contact surface oriented in a respective first plane, wherein the support plate and the plurality of contact pins are positioned within the receptacle shell, and wherein the receptacle shell has an opening for receiving the mating connector; wherein the mating connector comprises a first end of a flexible printed circuit board (PCB), wherein the PCB has a plurality of electrically conductive tracks terminating at respective first ends, all of which are proximate the first end of the PCB; a plurality of contact pads, each respectively electrically coupled to a respective conductive track, wherein each of the contact pads has a surface lying a plane at least essentially orthogonal to the respective first plane of each of the electrical contact surfaces of the respective contact pins to which it is electrically coupleable when electrically coupled thereto; a plurality of spring connectors, each having a respective first end and a second end, the respective first end of each being electrically coupled to a respective contact pad and the respective second end of each being electrically coupleable to a respective electrical contact surface of a contact pin; and a housing, shaped to be insertable within the opening of the USB connector, for enclosing (i) the first end of the PCB, (ii) the respective first ends of the conductive tracks, (iii) the plurality of contact pads and (iv) at least the respective first ends of the spring connectors.

In another preferred embodiment, the present invention is directed to an assembly comprising a USB connector and a micro universal serial bus (USB) connector in a specific preferred embodiment, wherein the USB connector comprises a receptacle shell, a plurality of contact pins mounted on a support plate, wherein each of the contact pins has an electrical contact surface oriented in a respective first plane, wherein the support plate and the plurality of contact pins are positioned within the receptacle shell, and wherein the receptacle shell has an opening for receiving a mating connector; and a mating connector comprising a first end of a flexible printed circuit board (PCB), wherein the PCB has a plurality of electrically conductive tracks terminating at respective first ends, all of which are proximate the first end of the PCB; a plurality of contact pads, each respectively electrically coupled to a respective conductive track, wherein each of the contact pads has a surface lying a plane at least essentially orthogonal to the respective first plane of each of the electrical contact surfaces of the respective contact pins to which it is electrically coupleable; a plurality of spring connectors, each having a respective first end and a second end, the respective first end of each being electrically coupled to a respective contact pad and the respective second end of each being electrically coupled to a respective contact surface of a contact pin; and a housing assembly, shaped to be insertable within the opening of the USB connector, for enclosing (i) the first end of the PCB, (ii) the respective first ends of the conductive tracks, (iii) the plurality of contact pads and (iv) at least the respective first ends of the spring connectors.

In a preferred embodiment, the mating connector of the present invention and the USB connector of the conventional type are integrated into an electronic device, such as a timepiece in the form of a wristwatch, although it is envisioned that the present invention is applicable to a wider range of electronic devices than those explicitly disclosed herein.

BRIEF DESCRIPTION OF THE DRAWINGS

The above set forth and other features of the invention are made more apparent in the ensuing Description of the Preferred Embodiments when read in conjunction with the attached Drawings, wherein.

Not all features are called out in each of the drawings but this is for convenience only and no limitation(s) should be inferred thereby.

DETAILED DESCRIPTION OF THE PREFERRED EMBODIMENTS

Generally speaking, preferred embodiments of the present disclosure will be described in detail with reference to the accompanying drawings. Prior to the disclosure however, it should be understood that the terms used in the specification and the appended claims should not be construed as limited to general and dictionary meanings, but interpreted based on the meanings and concepts corresponding to technical aspects of the present disclosure and on the basis of the principle that the inventor is allowed to define terms appropriately for the best explanation. Therefore, the disclosure herein is just a preferable example for the purpose of illustrations only, not intended to limit the scope of the disclosure, so it should be understood that other equivalents and modifications could be made thereto without departing from the spirit and scope of the disclosure.

Figure 2:
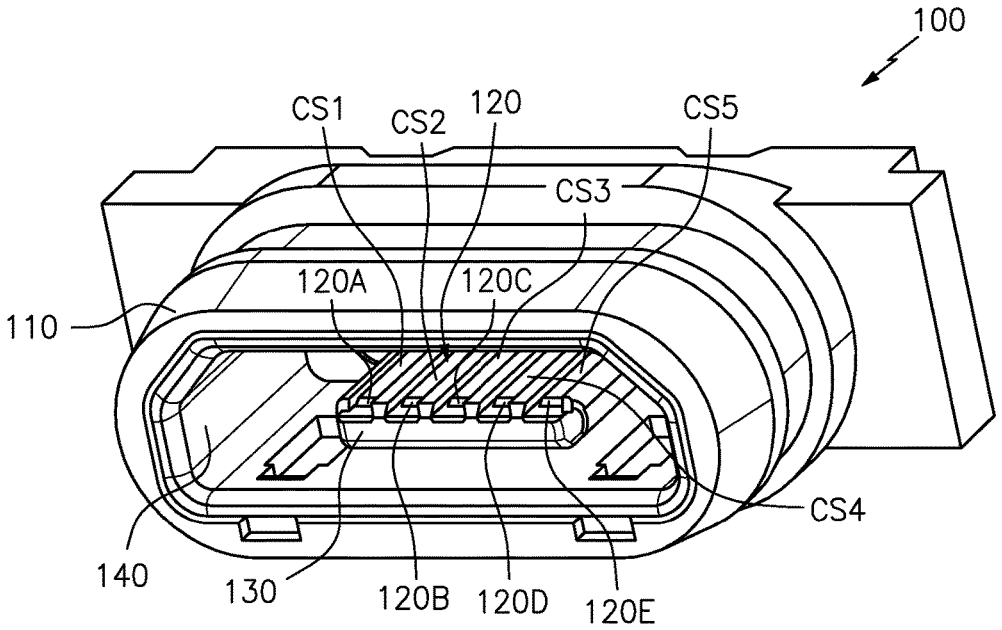
FIG. 2 (PRIOR ART)
FIG. 2 is a perspective view of the micro USB connector of FIG. 1 constructed in accordance with the prior art.
Figure 3:
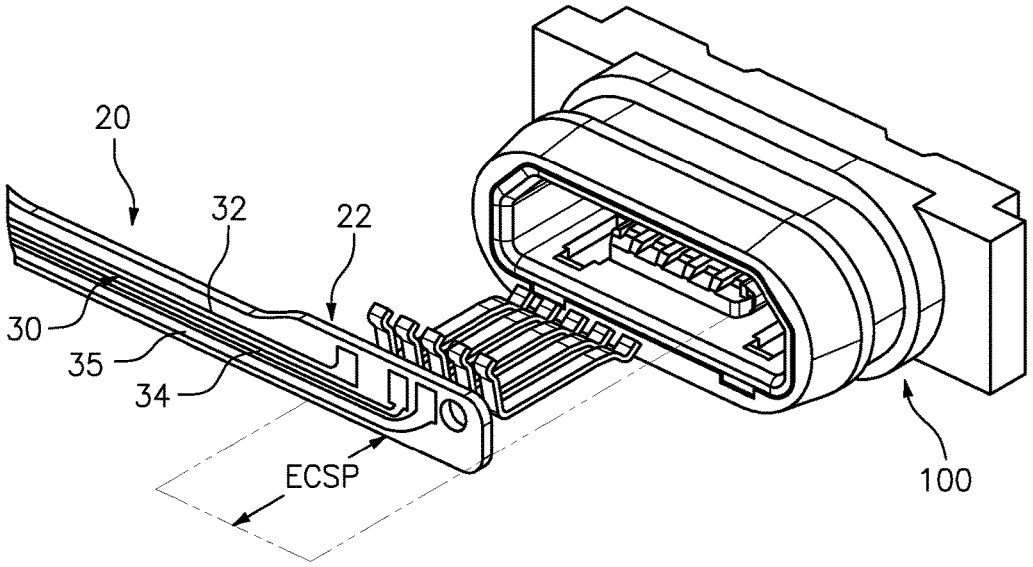
FIG. 3 is a perspective view of the micro USB connector of FIG. 2 and also showing an exploded view of certain components of a mating connector constructed in accordance with a first embodiment of the present invention.
Figure 8:
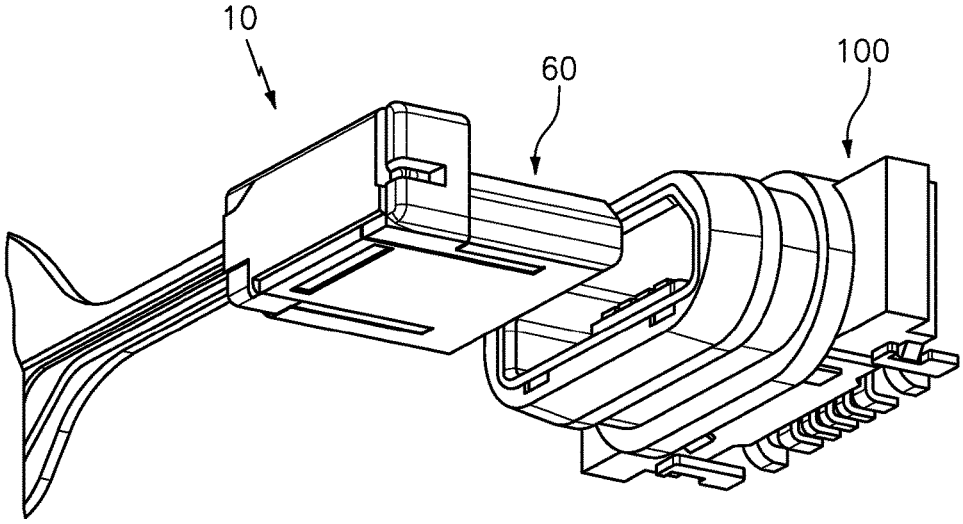
FIG. 8 shows the same perspective view of the micro USB connector of FIG. 2 and mating connector of FIG. 7, illustrating yet a further component of the housing of the mating connector, all constructed in accordance with a first embodiment of the present invention.

Generally speaking, and with reference now being made to the Figures, the present invention and the preferred embodiments thereof are directed to a mating connector, generally indicated at 10 (see FIGS. 8, 9), that mates with a USE connector generally and a micro universal serial bus (USB) connector in particular, such as the micro USB connector generally indicated at 100. As shown in FIG. 2, conventional USB connector 100 comprises a receptacle shell 110, a plurality of contact pins, generally indicated at 120 and individually indicated at 120A, 120B, 120C, 120D and/or 120E, mounted on a support plate 130, wherein each of the contact pins 120A, 120B, 120C, 120D and/or 120E has a respective electrical contact surface CS1, CS2, CS3, CS4, CS5 are preferably flat and oriented in a first plane. By reference to a "first plane," it is meant that the contact surfaces are such that they each lie in an electrical contact surface plane ("ECSP") as illustrated in FIG. 3. It should also be understood that the ECSP plane of each of the contact surfaces CS1, CS2, CS3, CS4, CS5 preferably are all identical, although slight variations, e.g. up to 25% variance in angles, as that term would be understood in the art, are contemplated herein and are within the scope of the invention. Preferably, the support plate 130 and the plurality of contact pins 120 are positioned within the receptacle shell 110. The receptacle shell has an opening 140 for receiving a mating connector 10 of the present invention, which will now be disclosed in greater detail.

That is, in accordance with a first embodiment of the present invention, mating connector 10 comprises a first end, generally indicated at 22, of a flexible printed circuit board (PCB), generally indicated at 20. As would be understood in the art, the PCB 20 has a plurality of electrically conductive tracks, generally indicated at 30 and individually illustrated in the figures at 31, 32, 33, 34, 35 each terminating at respective first ends, each of which is proximate the first end 22 of the PCB 20.

Reference to the "first end 22" is intended to refer to about the last 5 mm of the PCB 20, as it is of course obvious from the figures and to those skilled in the art that multiple pads are not positioned at the "actual end" of the PCB 20. Moreover, while the figures exemplary illustrate six (6) conductive tracks, this is by way of example only, and not limitation. Certainly, more or less conductive tracks can be utilized as needed or desired.

Figure 4:
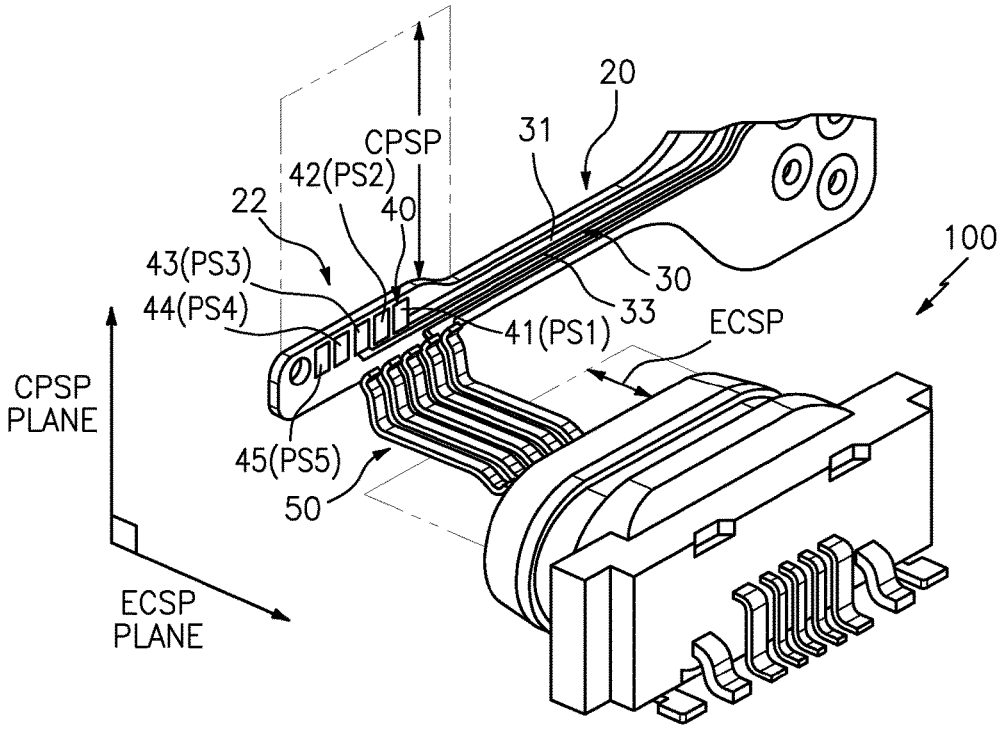
FIG. 4 is another perspective view of the micro USB connector of FIG. 2 and the components of the mating connector of FIG. 3.
Figure 5:
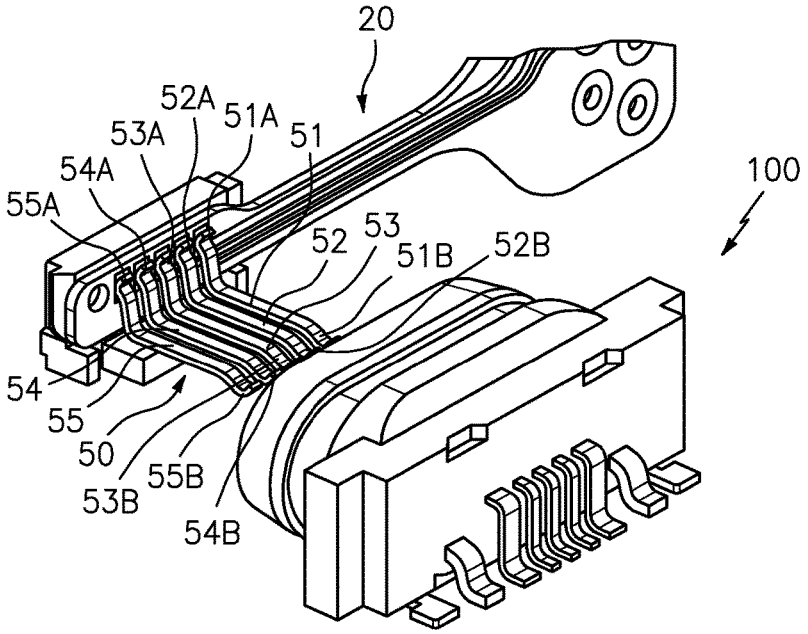
FIG. 5 is another perspective view of the micro USB connector of FIG. 2 illustrating yet further components of a mating connector constructed in accordance with a first embodiment of the present invention.
Figure 6:
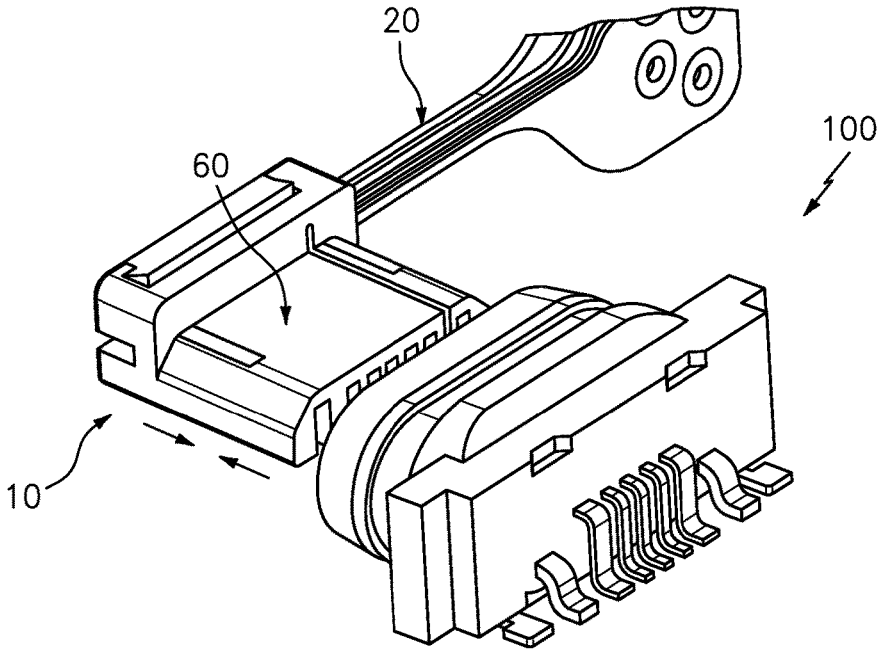
FIG. 6 is yet another perspective view of the micro USB connector of FIG. 2 illustrating yet further components of a mating connector constructed in accordance with a first embodiment of the present invention.
Figure 7:
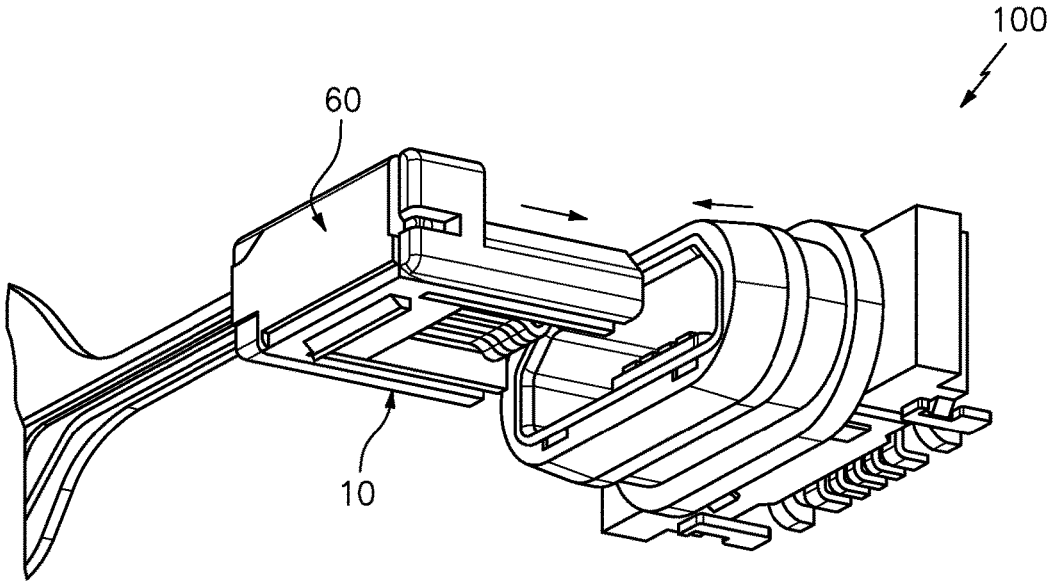
FIG. 7 is yet another perspective view of the micro USB connector of FIG. 2 and the mating connector of FIG. 6, further illustrating how the mating connector is to be inserted into the opening in the receptacle of the micro USB connector.
Figure 10:
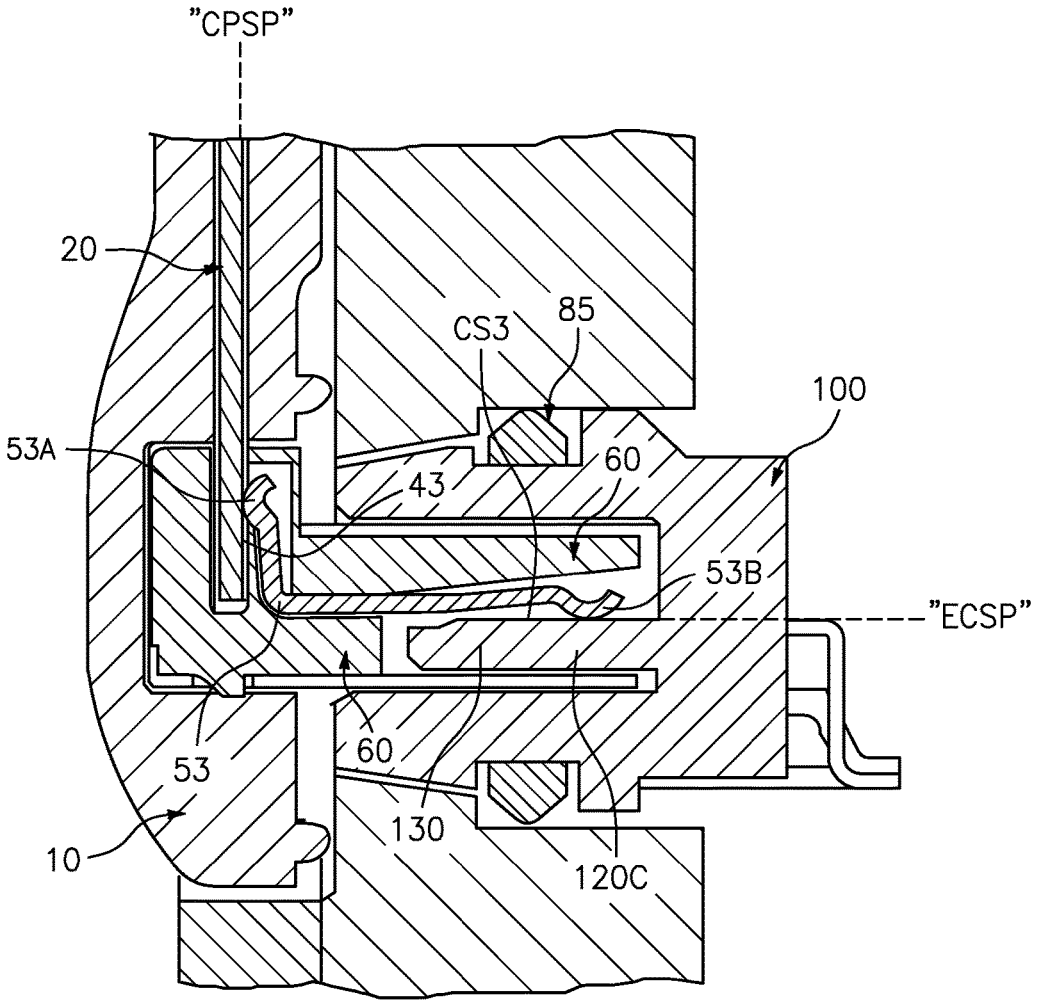
FIG. 10 is a cross-sectional view taken about lines 10-10 of FIG. 9, illustrating the orthogonal orientation of the electrical contact surface plane and the contact pad surface plane when mating connector 10 is inserted into receptacle 110 of USB connector 100.

As illustrated in FIG. 4, mating connector 10 further comprises a plurality of contact pads, generally indicated at 40 and individually illustrated in the figures at 41, 42, 43, 44, 45, each respectively electrically coupled to a respective conductive track 31, 32, 33, 34, 35 wherein each of the contact pads has a contact pad surface PS1, PS2, PS3, PS4, PS5 lying in a respective contact pad surface plane ("CPSP") that is at least essentially orthogonal to the plane ECSP of the respective electrical contact surface CS1, CS2, CS3, CS4, CS5 of the respective contact pins 120 to which it is electrically coupleable when electrically coupled thereto as illustrated in FIG. 10. The phrase "at least essentially orthogonal" is intended to mean within a 25% variance, which is consistent with the respective permitted variances of the ECSP planes of the respective contact surfaces as disclosed above.

In other words, the figures illustrate and the preferred embodiments of the present invention are directed to the novel feature in a micro USB connection assembly in which the ECSP plane of all/each of the contact surfaces CS1, CS2, CS3, CS4, CS5 of the respective pins 120 are all essentially orthogonal (i.e. within the aforementioned 25% variance) to the CPSP plane of each/all the contact pad surfaces PS1, PS2, PS3, PS4, PS5 of each of the respective contact pads 40. In contrast for example, it can be seen in U.S. Pat. No. 8,480,435 that the respective surfaces of the USB pins and the contact surfaces of the mating connector are all parallely oriented.

To therefore achieve the respective electrical connections between mating connector 10 and USB connector 100, mating connector 10 further comprises a plurality of spring connectors, generally indicated 50, and individually indicated in the figures at 51, 52, 53, 54, 55 each having a respective first end 51A, 52A, 53A, 54A, 55A and a second end 51B, 52B, 53B, 54B, 55B, the respective first ends of each 51A, 52A, 53A, 54A, 55A being electrically coupled to a respective contact pad 41, 42, 43, 44, 45 and the respective second end of each 51B, 52B, 53B, 54B, 55B being electrically coupleable to the respective electrical contact surface CS1, CS2, CS3, CS4, CS5 of respective contact pins 120A, 120B, 120C, 120D, 120E. FIG. 10 is an exemplary figure showing a corresponding electrical coupling having been achieved between a contact pad on the PCB 20 and a contact pin 120 in the USB connector 100. The remaining connections are similarly made. FIG. 10 also again illustrates the orthogonal alignment of electrical contact surface plane ("ECSP") and contact pad surface plane ("CPSP") when mating connector 10 is inserted into receptacle 110 of USB connector 100 and the respective electrical contact surfaces CS1, CS2, CS3, CS4, CS5 of the respective contact pins 120 are electrically coupled to the respective contact pads 41, 42, 43, 44, 45 in the mating connector 10.

Lastly, mating connector 10 comprises a housing, generally indicated at 60, shaped to be insertable within the opening 140 of the USB connector 100, for enclosing (i) the first end 22 of the PCB 20, (ii) the respective first ends of the conductive tracks 30, (iii) the plurality of contact pads 40 and (iv) at least the respective first ends 51A, 52A, 53A, 54A, 55A of the spring connectors 50.

Figure 1:
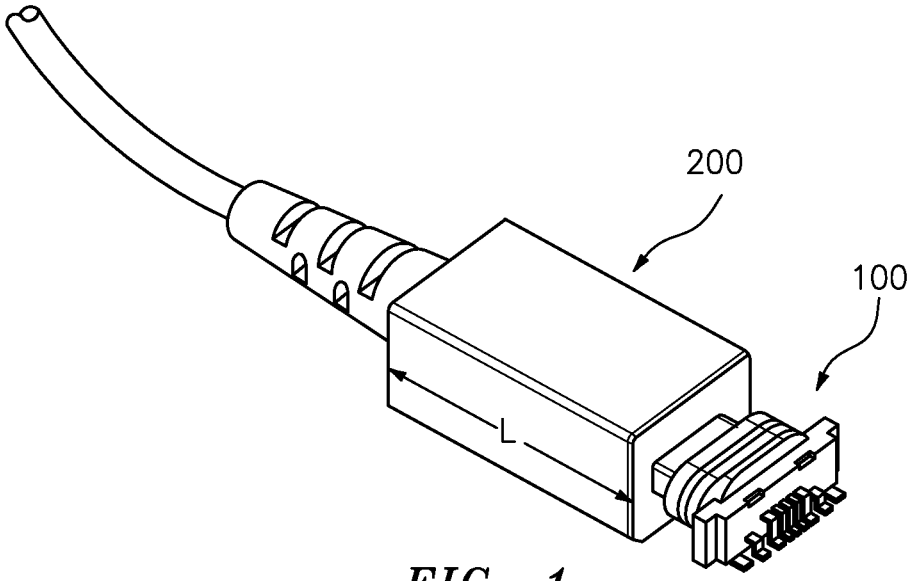
FIG. 1 (PRIOR ART)
FIG. 1 illustrates a USB connector assembly comprising a USB connector generally, and a micro USB connector in particular, and a mating connector all of which is constructed in accordance with the prior art.
Figure 12:
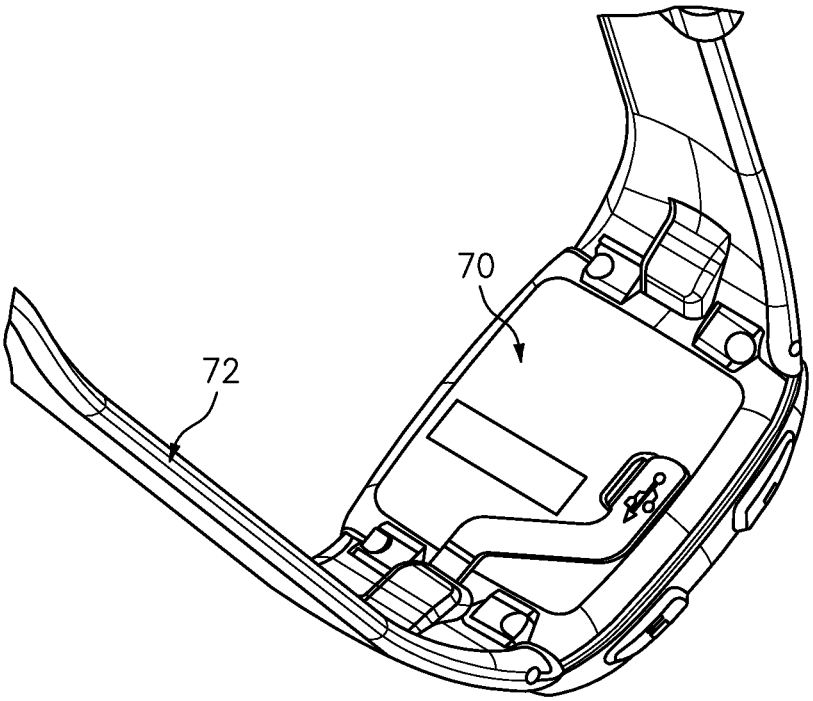
FIG. 12 is similar to that of FIG. 11, but additionally illustrating the protective cover to the completed assembly of FIG. 11.
Figure 9:
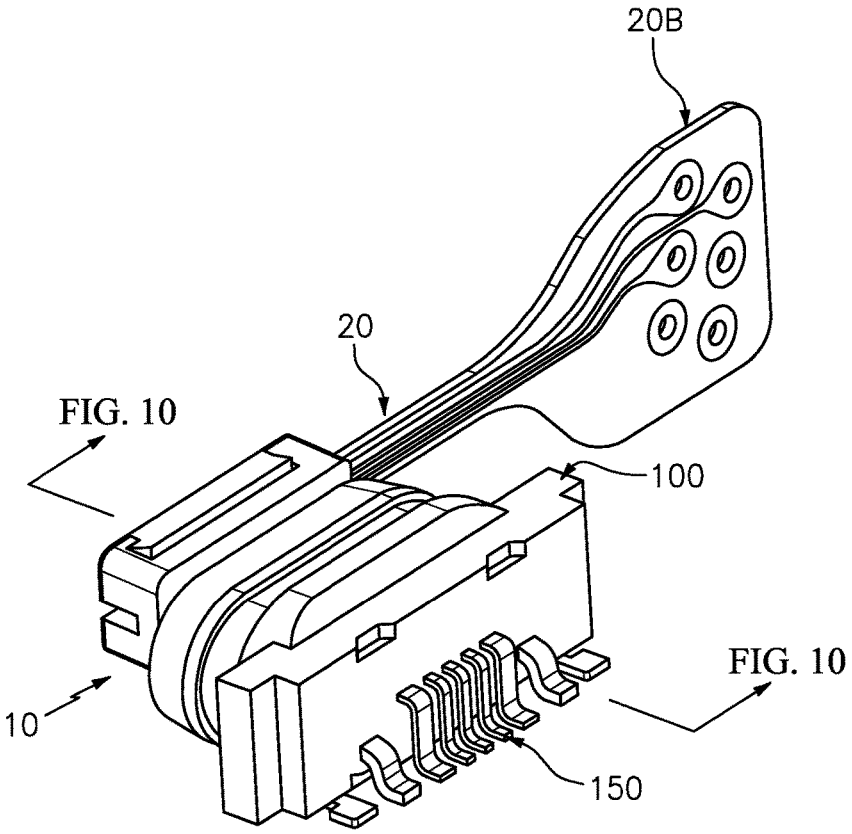
FIG. 9 is a perspective view of an assembly comprising the conventional micro USB connector of FIG. 2 and an assembled mating connector constructed in accordance with a first embodiment of the present invention.
Figure 11:
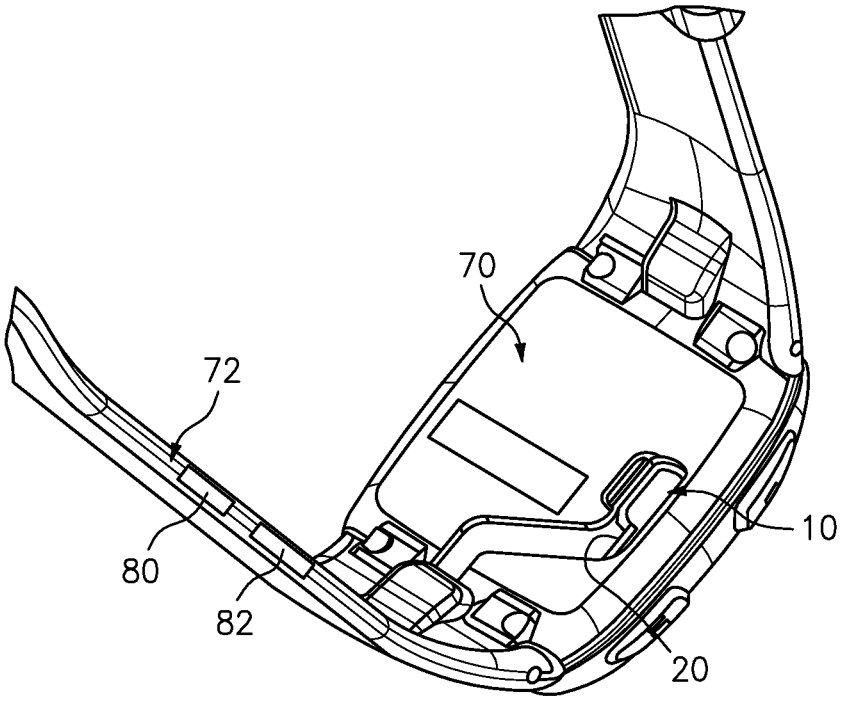
FIG. 11 is a perspective view of the back of a timepiece (e.g. wristwatch) illustrating the integration of an assembly comprising a conventionally designed micro USB connector such as that illustrated in FIG. 2 and a mating connector constructed in accordance with a first embodiment of the present invention.

The present invention can be incorporated into a plurality of electronic devices. However, devices to which the present invention is extremely useful is in the field of timepieces and to wristwatches in particular. For example, FIGS. 11 and 12 illustrate the incorporation of the present invention into a wristwatch comprising a watchhead, generally indicated at 70, and a wriststrap, generally indicated at 72. As disclosed above, one or more accessories, generically indicated at 80, 82, are depicted and may be, for example and not limitation, a flashlight, extra memory and/or an extra battery. As such, and utilizing the present invention, the circuitry in the watchcase 70 can now be electronically coupled to the circuitry and/or accessories in the watchstrap 72 via the conventional USB connector 100 and the mating connector 10 of the present invention. As such, and as illustrated in FIG. 9, it should be understood that the pin connections generally indicated at 150 would be connected to circuity/features in the watchcase 70, and the conductive tracks at an end 20B of PCB 20 would correspondingly be electrically coupled to features/accessories in the watchstrap 72, all as would be understood by those skilled in the art.

To ensure good electrical connections and water resistant properties, the present invention preferably incorporates one or more features directed thereto, such as integrated contact springs 50 that make improved connections with the contact pads 40 on the PCB 20. In addition, the mating connector 10 securely compresses the contact springs 50 against the PCB 20 when assembled, and integrated gaskets, e.g. gasket 85 (FIG. 10) are provided to ensure quality water resistant properties.

Other advantageous features of the present invention preferably include a dove-tail locking feature and locking slot in the metal shield for good reliable construction, and an improved gasket design on the overmolded housing of mating connector 10 that compresses against the case back of the watch head 70 when the wristwatch is on the user's wrist, although of course other means of locking and/or securing components, such as welding or gluing, can be used as would be understood in the art.

It can thus be seen that the present invention provides for an improved mating connector that is smaller and more compact than prior art mating connectors for USB connectors in general and micro USB connectors in particular, which can advantageously be used in electronic assemblies, such as timepieces generally and wristwatches in particular, which in turn facilitates for the expanded functionality of a timepiece, such as a wristwatch. In particular, it is the orientation of the contact pad electrical contact surface that is aligned orthogonally to the contact surface of the contact pins of a convention USB connector, which allows for a slimmer and more compact profile therefor. Still a further objective of the present invention is to provide an improved mating connector for micro USB connectors that can be used in electronic assemblies, such as timepieces generally and wristwatches in particular.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

The present invention is also applicable to a wide variety of devices and applications. That is, while the embodiments disclosed herein have been disclosed with reference to timepieces and wristwatches in particular, the scope of the invention is not so limiting.

What is claimed is:

1. A mating connector that mates with a universal serial bus (USB) connector, wherein the USB connector comprises a receptacle shell, a plurality of contact pins mounted on a support plate, wherein each of the contact pins has an electrical contact surface oriented in a respective first plane, wherein the support plate and the plurality of contact pins are positioned within the receptacle shell, and wherein the receptacle shell has an opening for receiving the mating connector; wherein the mating connector comprises:

a first end of a flexible printed circuit board (PCB), wherein the PCB has a plurality of electrically conductive tracks terminating at respective first ends, all of which are proximate the first end of the PCB;

a plurality of contact pads, each respectively electrically coupled to a respective conductive track, wherein each of the contact pads has a surface lying in a plane at least essentially orthogonal to the respective first plane of each of the electrical contact surfaces of the respective contact pin to which it is electrically coupleable when electrically coupled thereto;

a plurality of spring connectors, each having a respective first end and a second end, the respective first end of each being electrically coupled to a respective contact pad and the respective second end of each being electrically coupleable to a respective electrical contact surface of a contact pin; and a housing, shaped to be insertable within the opening of the USB connector, for enclosing (i) the first end of the PCB, (ii) the respective first ends of the conductive tracks, (iii) the plurality of contact pads and (iv) at least the respective first ends of the spring connectors.

2. The mating connector as claimed in claim 1, wherein the spring connectors are generally "L-shaped" spring connectors.

3. The mating connector as claimed in claim 1, wherein the USB connector is a micro USB connector.

4. An assembly comprising:

a universal serial bus (USE) connector, wherein the USB connector comprises:

a receptacle shell, a plurality of contact pins mounted on a support plate, wherein each of the contact pins has an electrical contact surface oriented in a first plane, wherein the support plate and the plurality of contact pins are positioned within the receptacle shell, and wherein the receptacle shell has an opening for receiving a mating connector;

a mating connector comprising:

a first end of a flexible printed circuit board (PCB), wherein the PCB has a plurality of electrically conductive tracks terminating at respective first ends, all of which are proximate the first end of the PCB;

a plurality of contact pads, each respectively electrically coupled to a respective conductive track, wherein each of the contact pads has a surface lying in a plane orthogonal to the first plane of each of the electrical contact surface of the respective contact pin to which it is electrically coupleable;

a plurality of spring connectors, each having a respective first end and a second end, the respective first end of each being electrically coupled to a respective contact pad and the respective second end of each being electrically coupled to a respective contact surface of a contact pin; and a housing, shaped to be insertable within the opening of the USB connector, for enclosing (i) the first end of the PCB, (ii) the respective first ends of the conductive tracks, (iii) the plurality of contact pads and (iv) at least the respective first ends of the spring connectors.

5. The assembly as claimed in claim 4, wherein the USB connector is a micro USE connector.

* * * * *